US012543876B2

(12) United States Patent
Barker et al.

(10) Patent No.: US 12,543,876 B2
(45) Date of Patent: Feb. 10, 2026

(54) GARMENT HANGER ASSEMBLY WITH REMOVABLE WIRE HOOK AND CORRUGATED HANGER BODY

(71) Applicant: Nexgen Packaging LLC, Westmont, IL (US)

(72) Inventors: Gary Barker, Oakland, CA (US); Michael Low, Pleasant Hill, CA (US); So Ching Tung, Hong Kong (HK)

(73) Assignee: Nexgen Packaging LLC, Westmont, IL (US)

( * ) Notice: Subject to any disclaimer, the term of this patent is extended or adjusted under 35 U.S.C. 154(b) by 0 days.

(21) Appl. No.: 18/200,991

(22) Filed: May 23, 2023

(65) Prior Publication Data

US 2025/0072640 A1 Mar. 6, 2025

(51) Int. Cl.
*A47G 25/38* (2006.01)

(52) U.S. Cl.
CPC ..... *A47G 25/38* (2013.01)

(58) Field of Classification Search
CPC ..... A47G 25/24; A47G 25/32; A47G 25/36; A47G 25/38
USPC ..... 223/87
See application file for complete search history.

(56) References Cited

U.S. PATENT DOCUMENTS

| | | | | |
|---|---|---|---|---|
| 2,191,714 | A * | 2/1940 | Gustin | A47G 25/24 D6/319 |
| 2,326,685 | A * | 8/1943 | Ruen | A47G 25/38 223/87 |
| 2,503,829 | A * | 4/1950 | Ludwig | A47G 25/38 223/92 |
| 8,899,454 | B2 | 12/2014 | Mainetti | |
| 11,051,642 | B1 | 7/2021 | Ho | |
| D927,865 | S | 8/2021 | Rhyner | |
| 11,134,804 | B2 | 10/2021 | Mackenzie | |
| 11,166,578 | B2 | 11/2021 | Mackenzie | |
| D953,045 | S | 5/2022 | Ho | |
| D953,756 | S | 6/2022 | Ho | |
| D961,278 | S | 8/2022 | Ho | |
| 2011/0049200 | A1 * | 3/2011 | Rodberg | A47G 25/1407 223/85 |
| 2022/0304490 | A1 | 9/2022 | Ho | |

FOREIGN PATENT DOCUMENTS

| | | | | |
|---|---|---|---|---|
| EP | 0576884 A1 * | 5/1994 | | A45C 9/00 |
| JP | 7195562 B1 * | 12/2022 | | |

* cited by examiner

*Primary Examiner* — Nathan E Durham
(74) *Attorney, Agent, or Firm* — Norvell IP LLC

(57) ABSTRACT

A garment hanger assembly comprising a multi-layered corrugated paper hanger body and a removable wire hook is disclosed. The multi-layered corrugated paper hanger body can be used with various removable hooks and has at least one layer that is oriented at substantially a 90° angle corrugation relative to an adjacent layer of corrugated paper. The removable wire hook can be used with various paper hanger bodies and has a horizontal extension that is configured to engage a hanger body when the wire hook is removably attached thereto.

17 Claims, 8 Drawing Sheets

FIG 4a
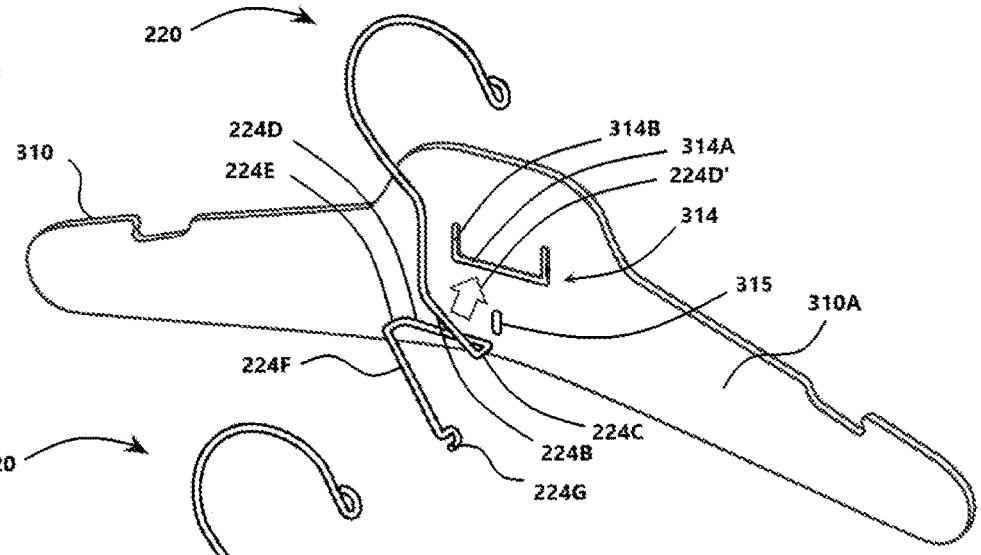
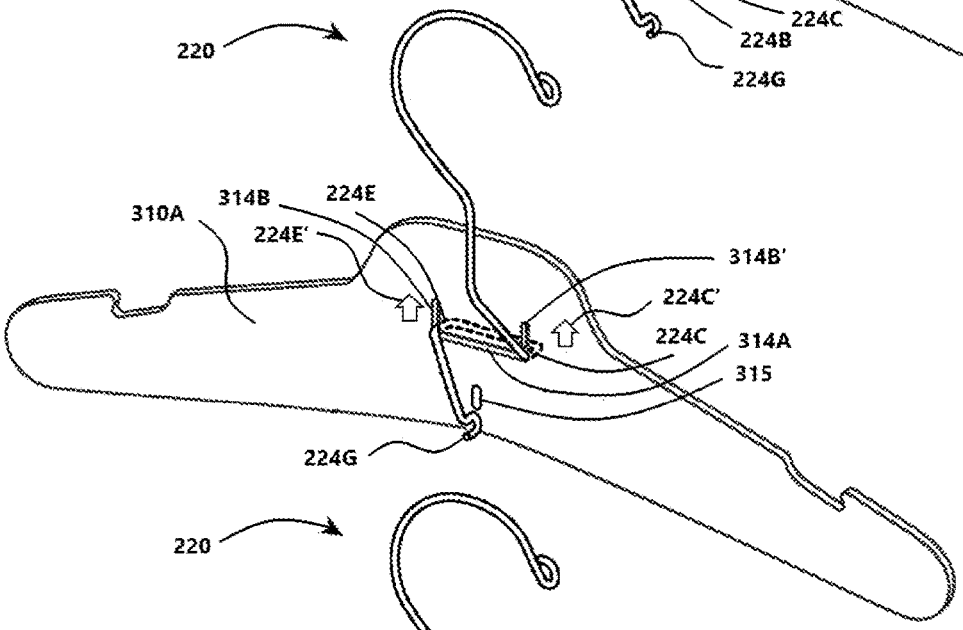
FIG 4b
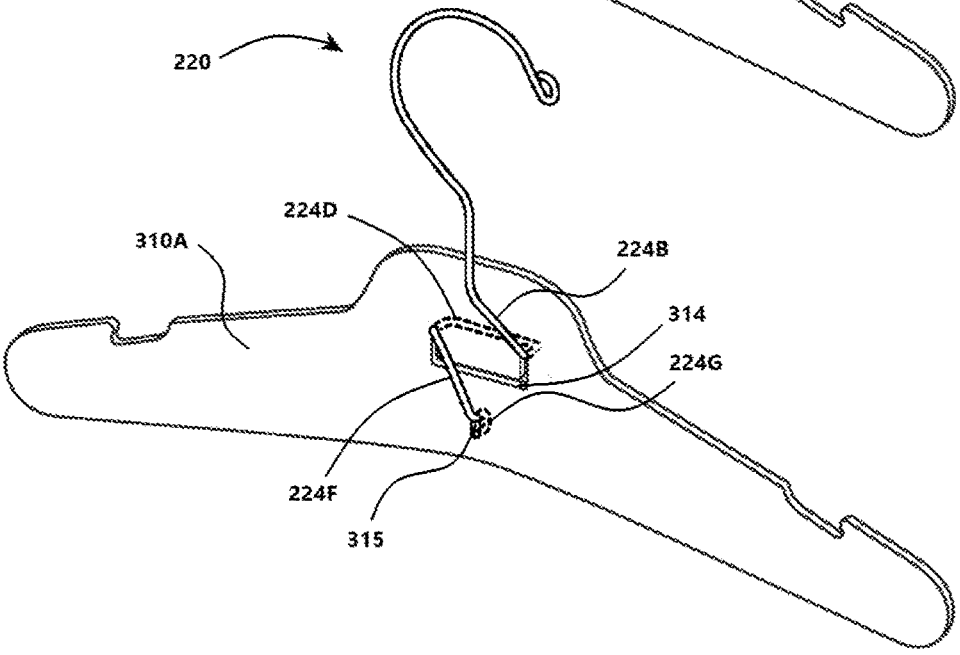
FIG 4c

GARMENT HANGER ASSEMBLY WITH REMOVABLE WIRE HOOK AND CORRUGATED HANGER BODY

FIELD OF THE INVENTION

The present invention relates generally to a garment hanger assembly with a recyclable, removable wire hook and a recyclable, corrugated paper hanger body.

BACKGROUND OF THE INVENTION

Traditional garment or clothing hangers are limited in design and utility for various retail and consumer applications. These hangers are made from plastic, metal, wood, or a combination thereof, and have been used to facilitate the hanging of clothing for more than a century. A typical garment hanger is usually comprised of a hanger body, which is shaped or contoured in the form of a triangle with two arms extending in opposite directions, and a metal or plastic hook provided centrally to the hanger body. The hanger body and hook are usually made from one piece of material and therefore cannot be removed from each other.

Retailers have, and still do, keep these traditional clothing hangers in stores, rarely if ever giving them to a customer. If a garment is sold, it is removed from the hanger and the sold garment packaged for the selling customer. The hanger itself is taken to a backroom of the store wherein it is introduced to a new article of clothing. This circular use of traditional clothing hangers is simple, but it comes with drawbacks. For example, the cost of replacing broken hangers is steep and the time used to hang a new article of clothing on an empty hanger is better spent on attending to paying customers.

Improvements in logistics and operational systems in the mid-1990's led to a new go-to storage method for the apparel and fashion industries, i.e. the Garment-on-Hanger (GOH) system, which drastically cut down the time and cost of using hangers in these industries. In a GOH system, garments are delivered to retail merchants already suspended from hangers, wherein upon arrival at the retail location the garments are immediately placed on display for sale. A garment is placed on a hanger and subsequently shipped from a manufacturer and/or distribution center to the retail establishment. The GOH system therefore affords an efficient way for the storage, transport, retrieval, and sortation of many articles of clothing. However, while costs associated with hangers and employee productivity are saved, the GOH system has seen a rise in shipping costs. For instance, fewer garments can fit in an individual shipping carton because of the space taken up by each hanger present therein, both because the hook portion on traditional hangers protrudes from the hanger body and because the thickness of each traditional hanger takes up vertical space, resulting in fewer garments packed in the same size shipping carton. Further, more space is needed at the manufacturing and/or distribution site, as well as the retail establishments, to accommodate the storage of the hangers and shipments of merchandise.

Perhaps more importantly, an estimated 85% of GOH hangers are eventually disposed in the trash by retail stores, ensuing in approximately 20 billion plastic GOH hangers being landfilled every year. Similarly, an estimated 300 million dry-cleaner wire hangers are landfilled every year. Most municipal recycling programs do not accept any traditional clothing hangers due to the varying mix of material for each hanger and the tangling of said hangers in recycling machinery.

The need to replace traditional hangers used in GOH systems has therefore been recognized for some time. The first all-paper fiberboard hangers began to surface in the 2000's, specifically for use in GOH programs. The all-paper hanger is thinner than traditional plastic shipping hangers, taking up 20% less room in shipping cartons than plastic hangers, while still being able to provide the strength needed for suspending an article of clothing. This efficiency translates to fewer cartons needed with each shipment, resulting in less shipping and labor costs, as well as requiring less space in distribution centers and storage rooms. Most importantly, paper fiberboard hangers are recyclable, both at the store or dry-cleaner level, as well as with a customer once the article of clothing and the hanger are taken home. All-paper hangers do not, however, come without deficiencies. For one, the paper hanger remains relatively thick in diameter at the hook portion, making it unpracticable in industries such as dry-cleaning, which uses overhead conveyer machinery having narrow constriction points and designed for using all-wire hangers with very thin diameter. All-paper hangers additionally require employing a large amount of material due to the difficulty in efficiently nesting the cutting dies because of the awkward placement of the hook portions.

Recently, plastic hangers with a collapsible plastic hook, like the one disclosed in U.S. Pat. No. 11,051,642 to Ho, have been utilized by clothing manufacturers and/or distributors to minimize the space needed in cartons or packages for sending clothing via a GOH method to retailers. While the collapsible plastic hook works well for plastic hangers, it presents mechanical issues for use with a paper hanger body. In addition, garment hangers with plastic bodies are still too thick for shipping clothing efficiently in a GOH method. US 2022/0300490 to Ho discloses a plastic two-piece plastic hook for a paper garment hanger, wherein the plastic hanger hook includes 1) a hanger body with a base having a "collar" or protuberance that can fit snuggly through an opening of a paper hanger body, and 2) a locking member with a sizer body portion and a "tongue" extending therefrom, wherein the tongue includes an opening for engaging the collar when the sizer body portion of the locking member is fitted down over the hook body and positioned at the base thereof. Although the plastic hook disclosed in US 2022/0300490 allows for a simple way to permanently secure a plastic hook to a paper-based hanger body, it is still not optimal for use in GOH systems since the assembled plastic hanger requires more packaging space because of the protruding hook, resulting in the use of larger cartons.

A removable hook for a hanger body as disclosed in U.S. Pat. No. 8,899,454 to Mainetti cures some of the deficiencies of the prior art. However, the Mainetti hook is limited in use to a plastic or metal hanger body that is arched. U.S. Pat. No. 11,134,804 to Mackenzie teaches two distinct removable hooks for a paper hanger body. One hook requires a wire hook with a bracket that is not sturdy and difficult to attach and remove from the hanger body, the bracket also including sharp edges that can easily damage a paper hanger body. The other hook disclosed in Mackenzie is a bent wire hook which is also difficult to attach and remove and is not aesthetically pleasing for use in stores.

There therefore still exists a need for a lower cost garment hanger assembly for use in any business that uses a GOH method, such as the dry cleaning, garment and fashion industries. To reduce the thickness of the hanger in taking up less vertical space within a carton, the garment hanger body of the garment hanger assembly can made of a durable, lightweight material such as paper. In particular, hangers made from corrugated paper provide an even lower cost alternative approach to other paper body hangers, such as for example, pressed fiberboard body hangers. While there are already paper hangers on the market made from corrugated cardboard, they are extremely weak and prone to failure. As disclosed herein, affording a garment assembly wherein the paper hanger body is made from two or more layers of corrugated paper where each layer is oriented at a 90° angle corrugation to each adjacent layer provides a much stronger structure to the finished paper hanger body.

In addition, to avoid using larger cartons which are presently employed in GOH systems, the garment assembly disclosed herein includes a removable wire hook such that garments can be shipped with only a hanger body. Once shipped to the retailer, each article of clothing in a GOH carton is removed by grabbing the hanger body that said article of clothing is suspended from and removably attaching a wire hanger hook made from a durable and recyclable material. Both the corrugated paper hanger body and the removable wire hanger hook are made from recyclable materials making it practical for the dry-cleaning and the GOH industries. Accordingly, a paper hanger assembly including a corrugated paper hanger body and a removable wire hanger hook is disclosed. The paper hanger assembly as disclosed herein can be used in the dry-cleaning industry and/or the GOH industries and generally employs a fastening mechanism on the removable wire hanger hook for the facile removable attachment of the hanger hook to the paper hanger body.

SUMMARY OF THE INVENTION

In light of the foregoing, it is an object of the present invention to provide a garment hanger assembly comprising a corrugated paper hanger body and a removable wire hanger hook. The paper hanger body is made from at least two layers of corrugated paper and has a shape of a garment hanger that includes a central region, a first side region extending from the central region in a first direction, and a second side region extending from the central region in a second direction and opposing the first direction. The hanger body cures the deficiencies of other corrugated garment hanger bodies in that a first layer of corrugated paper is oriented at substantially a 90° angle corrugation relative to an adjacent second layer of corrugated paper. The garment hanger assembly also comprises a removable wire hook comprising a distal hook end and a proximal base end. The distal hook end comprises a hook followed by a vertical extension, while the proximal base end comprises a horizontal extension that is perpendicular to the vertical extension of the distal hook end. The horizontal extension is configured to engage the hanger body when the wire hook is removably attached to said hanger body. It will be understood by those skilled in the art that one or more aspects of this invention can meet certain objectives, while one or more other aspects can meet certain other objectives. Each objective may not apply equally, in all its respects, to every aspect of this invention. As such, the following objects can be viewed in the alternative with respect to any one aspect of this invention.

Accordingly, it can also be an object of the present invention to provide a paper hanger body made from at least two layers of corrugated paper and having a shape of a garment hanger with a central region, a first side region extending from the central region in a first direction, and a second side region extending from the central region in a second direction opposing the first direction. The at least two layers of corrugated paper include a first layer of corrugated paper that is oriented at substantially a 90° angle corrugation relative to an adjacent second layer of corrugated paper.

It is another object of the present invention to provide a removable wire hook for a garment hanger. The removable wire hook comprises a distal hook end and a proximal base end, wherein the distal hook end comprises a hook followed by a vertical extension. The proximal base end comprises a horizontal extension that is perpendicular to the vertical extension of the distal hook end. The horizontal extension is configured to engage a garment hanger body, and in particular an aperture in the hanger body, when the wire hook is removably attached to the hanger body. Once the horizontal extension of the removable wire hook is fully inserted into the aperture, the removable wire hook is engaged and removably fastened to said garment hanger body.

As provided herein, the removable hanger hook of the garment hanger assembly is made from recyclable material and is either a rotatable or a fixed-in-place hook (fixed hook) with no rotation, preventing any horizontal movement when removable attached to the garment hanger body. The removable wire hook can be used in any industry, in particular one that employs a Garment-On-Hanger (GOH) system, such as for example, garment or fashion industries, wherein at one end the garment is placed in a packaging carton by the manufacturer or distributor suspended only from the hanger body, and at the other end the garment is removed by a retailer by grabbing the hanger body that the garment is suspended from and removably attaching the removable wire hanger hook. Shipping costs in GOH methods are therefore drastically reduced for two reasons. First, more garments can be added to each packaging carton because the thicker, traditional hangers are eliminated. Second, because the removable wire hook is removed from the paper hanger body, larger GOH cartons can be replaced with shorter cartons as the space taken up by "protruding" hook portions of traditional hangers is also eliminated. To this end, removable wire hooks can be kept in any retailer store or warehouse and assembled to the garment hanger bodies at any time.

The removable wire hook of the garment hanger assembly can also be used in the dry-cleaning industry, which employs overhead conveyer machinery having narrow constriction points and designed for using all-wire hangers thereon. Using an all-paper hanger with a thick hook portion is not feasible as the conveyers have narrow constriction points. However, the removable wire hook as described herein is manufactured at a narrow diameter so as to be able to run through the constriction points of the conveyer system without incident. The paper hanger body can be replaced when necessary by removing it from the removable wire hook. Further, eliminating the hook portion from an all-paper hanger and using a removable hook with a paper hanger body brings the price of the hanger down as it takes less paper to make the hanger (i.e. no paper hook), and the hook can be used numerous times, bringing down the overall price of the garment hanger assembly as described herein.

Other objects, features, benefits and advantages of the present invention will be apparent from this summary and the following descriptions of certain embodiments and will be readily apparent to those skilled in the art having knowledge of garment hangers. Such objects, features, benefits and advantages will be apparent from the above as taken into conjunction with the accompanying examples, figures and all reasonable inferences to be drawn therefrom. The disclosures in this application of all articles and references, including patents, are incorporated herein by reference.

BRIEF DESCRIPTION OF THE DRAWINGS

FIG. 4*a* is a rear perspective view of aligning the proximal base end of the wire hook of FIGS. 2*a*-2*f* with an aperture of the hanger body of FIG. 3; FIG. 4*b* is a rear perspective view of inserting the proximal base end of the wire hook of FIGS. 2*a*-2*f* with the aperture of the hanger body of FIG. 3; and FIG. 4*c* is a rear perspective view of removably locking the proximal base end of the wire hook of FIGS. 2*a*-2*f* with the aperture of the hanger body of FIG. 3.

DETAILED DESCRIPTION OF INVENTION

As it relates to certain non-limiting embodiments, the present invention relates to a garment hanger assembly comprising a multi-layered corrugated paper hanger body and a removable (or releasable) wire hook. The removable wire hook, together with the corrugated paper hanger body that the hook removably attaches to, affords a garment hanger assembly which cures the deficiencies of the prior art. Specifically, the removable wire hook includes a hook end and a base end, the base end having at least a front side and a back side. At least one fastening mechanism is located on the removable wire hook. The multi-layered corrugated paper hanger body of the garment hanger assembly includes at least a first layer of corrugated paper that is oriented at substantially a 90° angle corrugation relative to an adjacent second layer of corrugated paper to afford greater strength to said hanger body.

According to one feature of the illustrated embodiments, the hanger body of the garment hanger assembly as described herein is made from a biodegradable material such as corrugated paper. More specifically, the hanger body is made from a molded paper or pulp. Such molded paper can include, for example, pulp paper, pulp fiber, foamed paper pulp, recycled newspaper, brown paper, white paper, sugar cane pulp, bamboo pulp fibers, and/or any other suitable biodegradable material. Preferably, a semi-rigid, lightweight and durable sheet paper material is used, such as for example, paperboard or cardboard. The hanger body can be formed from a variety of methods, including for example by die cutting, and can consist of one or more, preferably several layers of sheet paper material. A semi-rigid cardboard is preferred because it is easily cut into the desired shape and readily folded and joined to another piece of cardboard by adhesive or other forms of connection. The hanger body formed from this type of material is inexpensive to manufacture yet suitably strong for its intended task. These hangers can be repeatedly used and, when unusable, are readily disposed of by recycling. It will be appreciated by those skilled in the art that the sheet material is any semi-rigid, lightweight, durable, readily formed, foldable sheet-like material. Paper products, such as cardboard and paperboard, are preferred because they are readily disposed of by recycling. However, other types of paper products can be used as well.

Figure 6A:
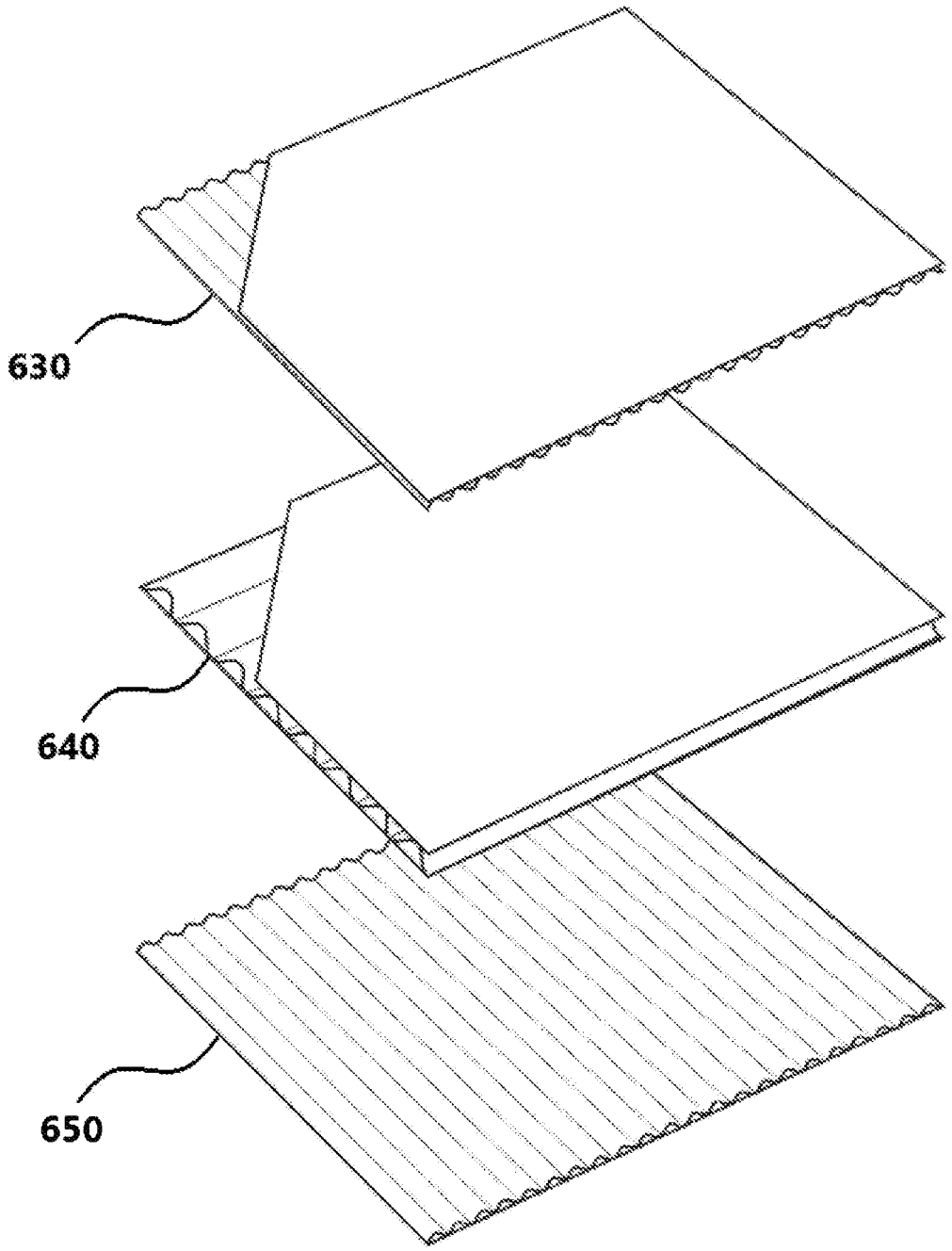
FIG. 6*a* is an exploded view of the top of an embodiment for a multi-layered corrugated paper body.
Figure 6B:
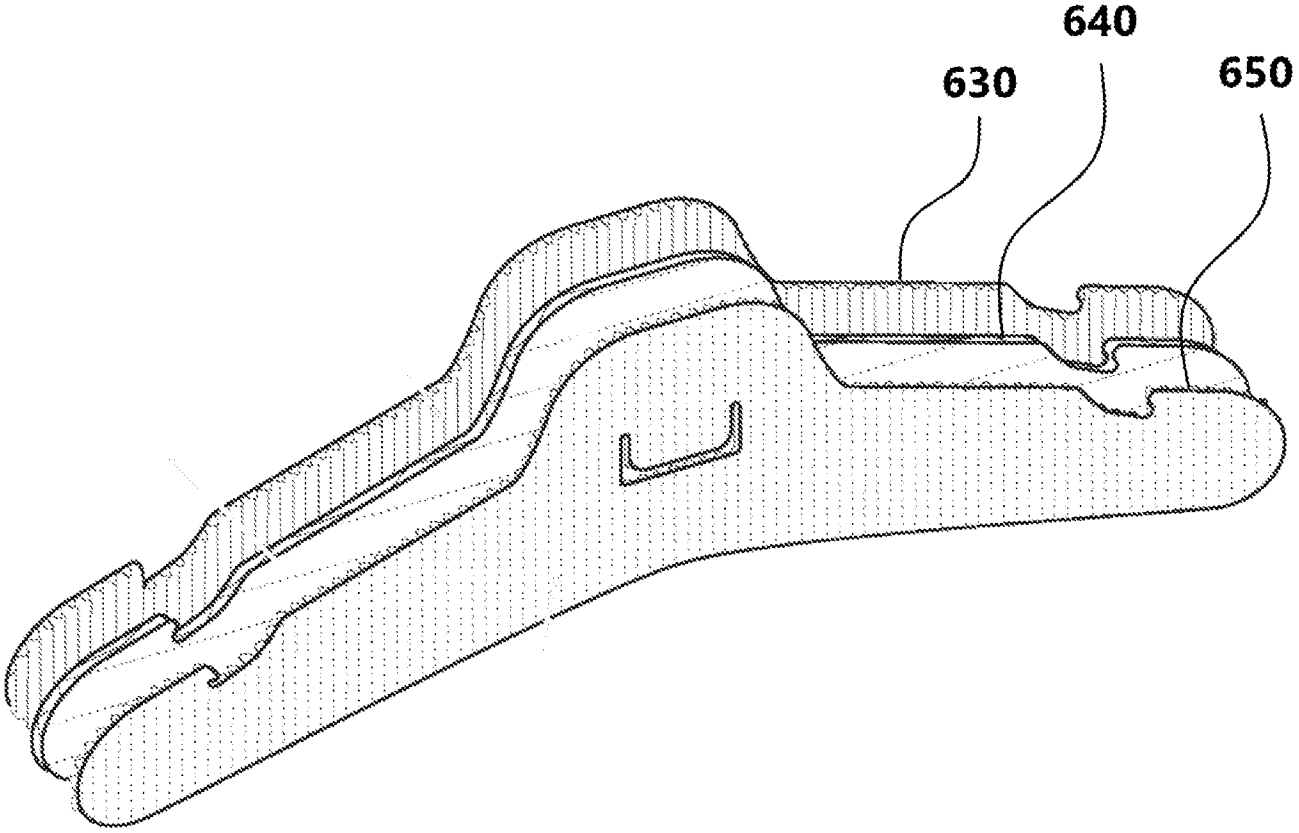
FIG. 6*b* is an exploded view of the front of an embodiment for a multi-layered corrugated paper body.

In one embodiment, the multi-layered corrugated paper hanger comprises at least two adjacent layers of different flute-sized paper, each constructed of corrugated paper with preferably a small flute size approximating the E-flute (90±4 flutes per foot) or F-flute (125±4), more preferably at least one layer of E-flute and at least one layer of F-flute. However, it is to be appreciated that various other flute sizes can also be used. As used herein, flute size generally refers to the number of flutes per linear foot of paper. Each layer of corrugated paper can include two or more sub-layers of the same fluted sized paper, the sub-layers in each layer oriented in the same direction of corrugation. In addition, each layer of corrugated paper is affixed to, and preferably laminated to, an adjacent layer in an orientation of substantially a 90° angle corrugation relative to said adjacent layer. In an even more preferred embodiment, and referring to FIG. 6*a*, which is an exploded view of the top of a multi-layered corrugated paper hanger, said multi-layered corrugated paper hanger is made from three layers of corrugated paper, wherein a first layer 630 is a small flute size, for example, approximating the E-flute, a second, middle layer 640 is of a different flute size, for example, approximating the F-flute, and a third layer 650 is of the same size as the first layer, for example, approximating the E-flute. In yet an even more preferred embodiment, each of the three layers 630, 640, 650 include two or more sub-layers of the same fluted sized paper, the sub-layers oriented in the same direction of corrugation. For example, FIG. 6*b* depicts and exploded view of the front of a multi-layered corrugated paper hanger, including a first layer 630 comprising two sub-layers of E-flute sized corrugated paper oriented in the same direction, i.e. a horizontal flute orientation. A second layer 640 comprises three sub-layers of F-flute sized corrugated paper oriented in the same direction of corrugation and in substantially a 90° angle corrugation relative to first layer 630, i.e. a vertical flute orientation. Finally, a third layer 650 comprises two sub-layers of E-flute sized corrugated paper oriented in the same direction and in substantially a 90° angle corrugation relative to second layer 640, i.e. a horizontal flute orientation. The two different sizes of fluting as provided in this example afford a stronger structure to the finished product of multi-layered corrugated paper hanger.

Corresponding to another feature of the illustrated embodiments, the shape, dimensions and material of the removable wire hook can vary depending on the type of garment hanger body employed. The hanger body, including its shape, is in turn dependent on the type of clothing being suspended therefrom. Regardless, the removable wire hook as described herein is preferably made of a single-piece, sturdy, recyclable material that traditional wire hangers are made of, i.e. stress-hardened steel wire that may or may not be coated with a thin lacquer.

Accordingly, the following presents non-limiting examples of an embodiment for a garment hanger assembly.

It is to be understood that while terms such as "left", "right", "top," "bottom," "front," "back," "side," "rear," "down," "up" and the like may be used in this specification to describe various example features and elements of the invention, these terms are used herein as a matter of convenience, e.g., based on the example orientations shown in the figures or the orientation during typical use.

Figure 1A:
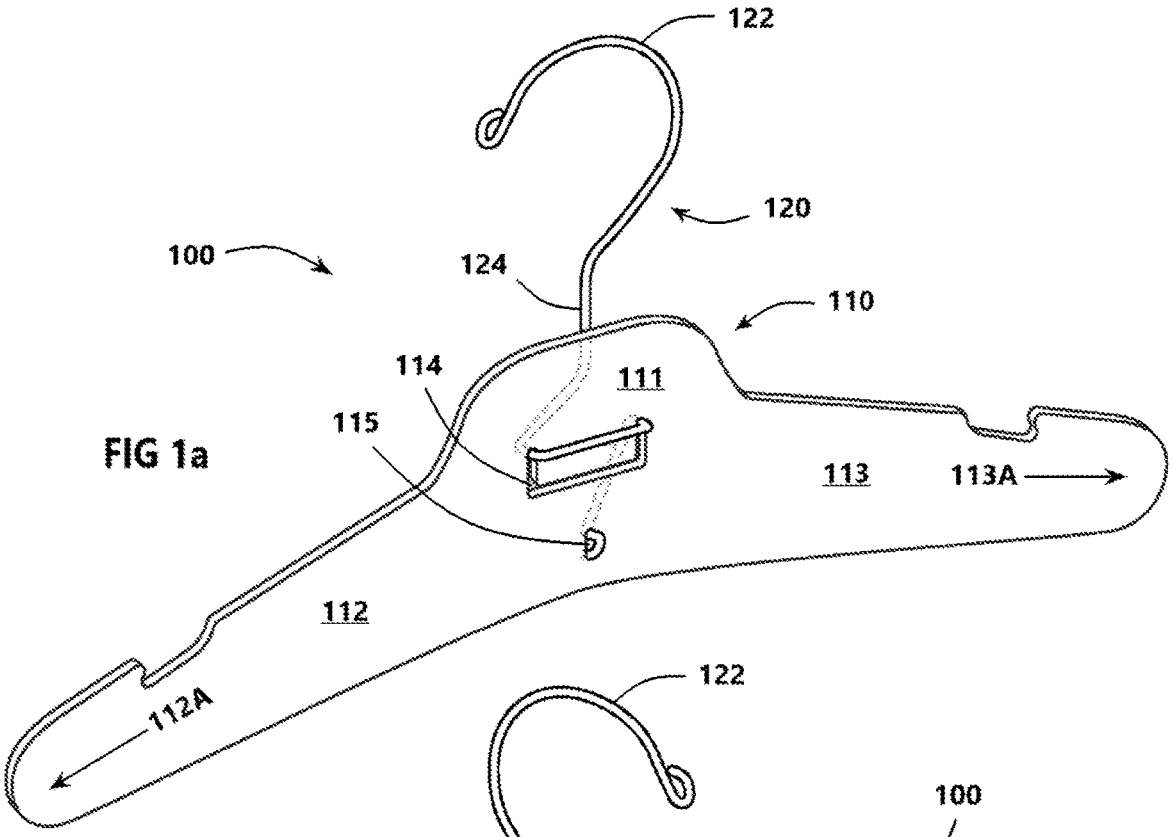
FIG. 1*a* is a front perspective view of a garment hanger assembly.
Figure 1B:
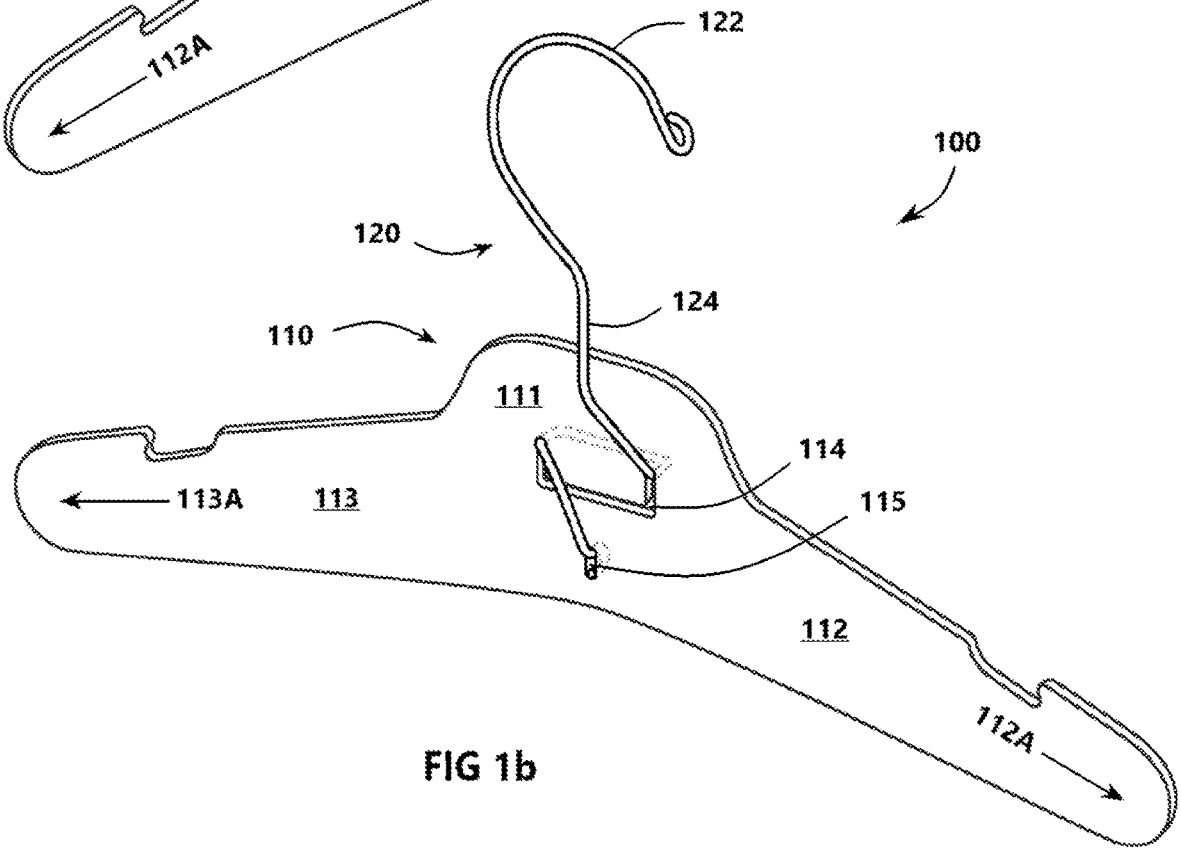
FIG. 1*b* is a rear perspective view of the garment hanger assembly of FIG. 1*a*.

Referring to specific non-limiting embodiments depicted in the drawings, the garment hanger assembly comprises a multi-layered corrugated paper hanger body and a removable wire hanger hook. FIG. 1*a* and FIG. 1*b* shows a front perspective view and rear perspective view, respectively, of an embodiment of a garment hanger assembly 100 according to the present invention. The garment hanger assembly 100 comprises a hanger body 110 made from at least two layers of corrugated paper and having a shape of a garment hanger with a central region 111, a first side region 112 extending from the central region 111 in a first direction 112A, and a second side region 113 extending from the central region 111 in a second direction 113A and opposing the first direction 112A. At least one aperture 114, and preferably a second aperture 115, is included in the central region 111 of the hanger body 110. Additionally, the garment hanger assembly includes a removable wire hook 120 comprising a distal hook end 122 and a proximal base end 124, a portion of which is indicated in broken lines as not shown in both FIG. 1*a* and FIG. 1*b*.

Figure 2A:
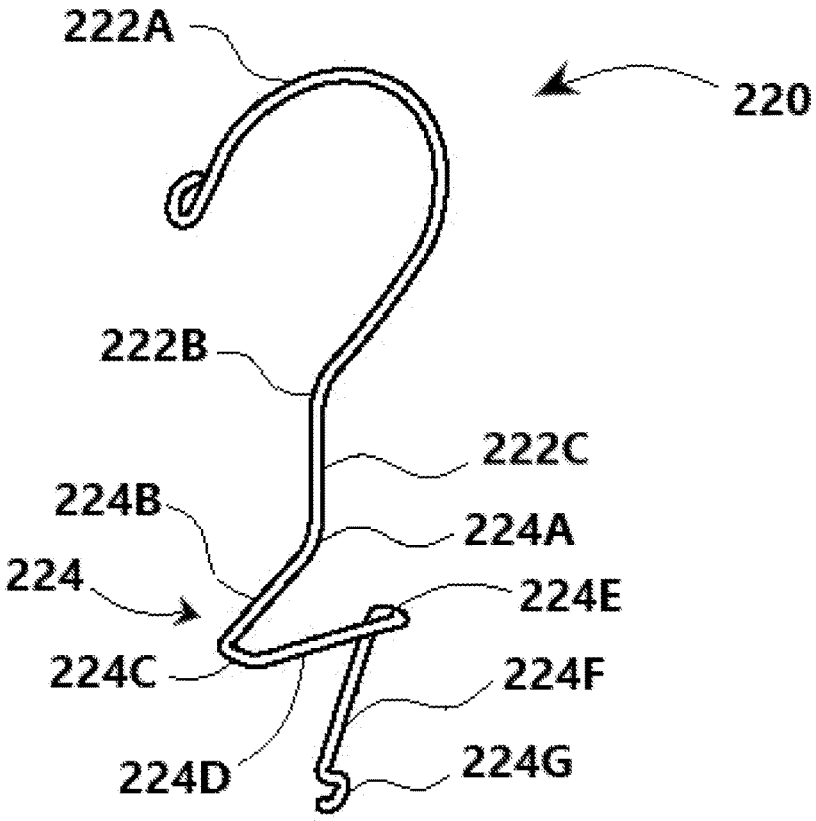
FIG. 2*a* is a front perspective view of a removable wire hook.
Figure 2B:
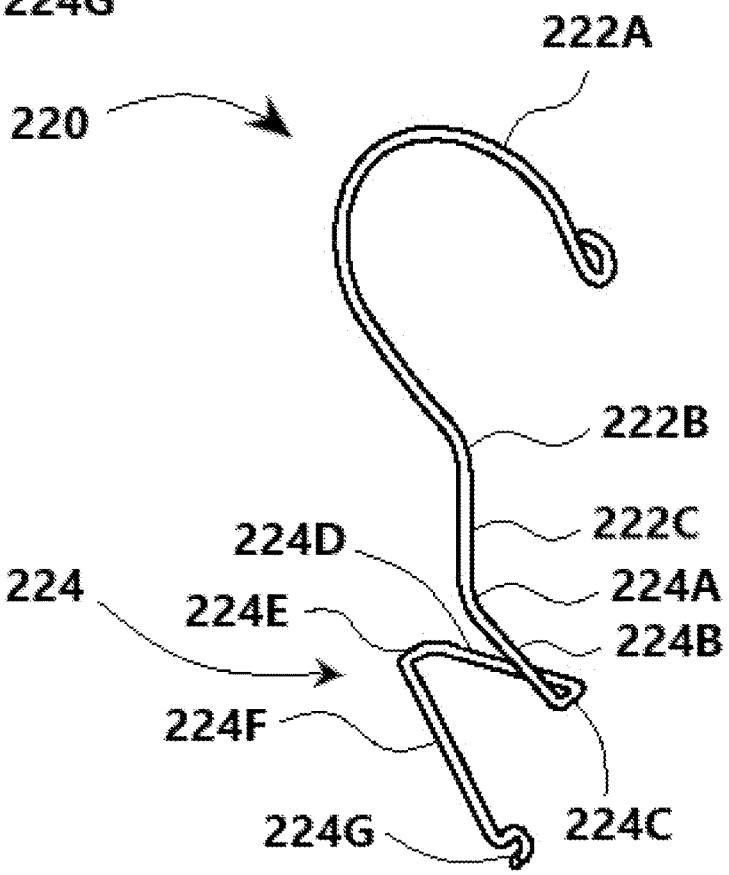
FIG. 2*b* is a rear perspective view of the removable wire hook.
Figure 2C:
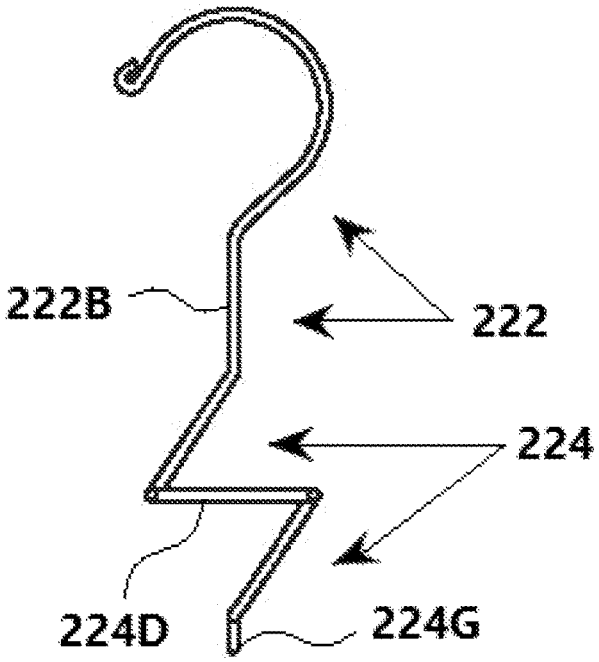
FIG. 2*c* is a front view of the removable wire hook.
Figure 2D:
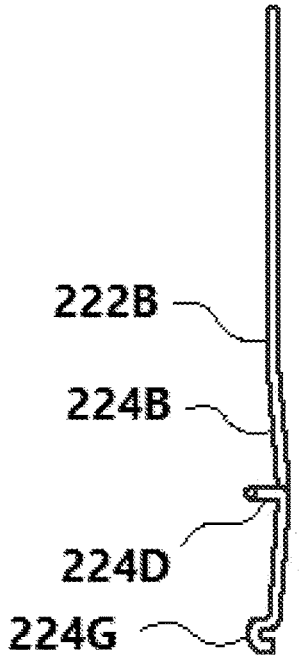
FIG. 2*d* is a side view of the removable wire hook of FIG. 2*c* rotated 90° to the left.
Figure 2E:
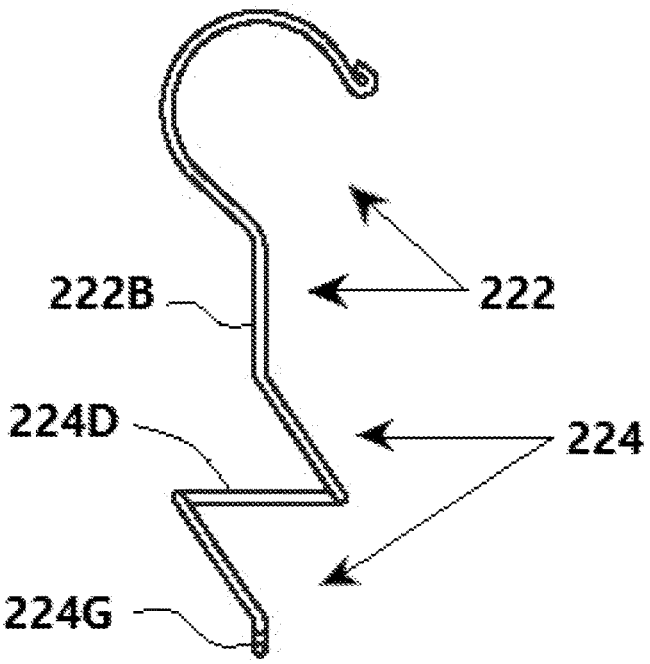
FIG. 2*e* is a rear view of the removable wire hook of FIG. 2*c* rotated 180° to the left.
Figure 2F:
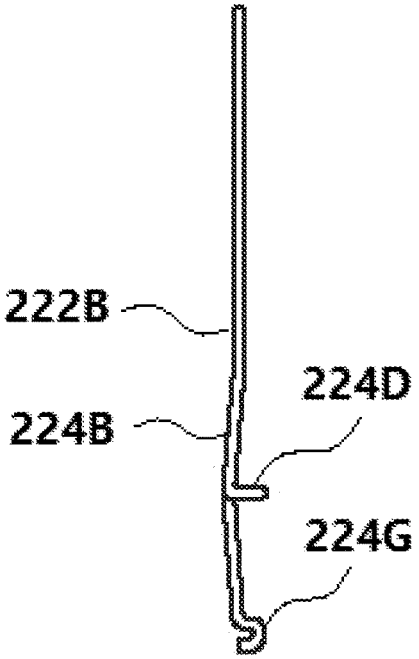
FIG. 2*f* is the other side of the removable wire hook of FIG. 2*c* rotated 90° to the right.

FIG. 2*a* and FIG. 2*b* show a front perspective view and rear perspective view, respectively, of an embodiment for the removable wire hook 220 as can be used for the garment assembly of FIG. 1*a* and FIG. 1*b*. The distal hook end 222 of wire hook 220 includes an arcuate hook 222A followed by a vertical extension 222B, while the proximal base end 224 comprises a horizontal extension 224D that is substantially perpendicular to the vertical extension 222B of the distal hook end 222, as seen in the front and rear views, FIG. 2*c* and FIG. 2*e*, respectively. The horizontal extension 224D is configured to engage a portion of the hanger body when the wire hook 220 is removably attached to said hanger body. The proximal base end 224 of the removable wire hook 220 can further comprise a first support arm 224B that extends at an angle from a first arm end 224A in a medial direction (i.e. in a direction with the arcuate hook 222A). Alternatively, the first support arm 224B can extend at an angle from the first arm end 224A in a lateral direction (i.e. in a direction against the arcuate hook 222A). Preferably, the first support arm 224B extends medially or laterally from the first arm end 222A in substantially a same plane as the vertical extension 222B of the distal hook end 222, as shown in the left- and right-side views, FIG. 2*d* and FIG. 2*f*, respectively. Regardless, the first support arm 224B continues to extend at an angle towards a second arm end 224C, said second arm end 224C further extending into the horizontal extension 224D of the proximal base end 224. The second arm end 224C extends from the first support arm 224B and into the horizontal extension 224D in a direction, preferably at substantially a 90° angle, such that said horizontal extension 224D lies in a different plane than said first support arm 224B. Preferably, the horizontal extension 224D therefore also lies in a different plane than the first support arm 224B. The horizontal extension 224D continues to extend horizontally into a third arm end 224E that itself extends back in an opposite and equal direction, preferably at substantially a 90° angle, from where the second arm end 224C extends into said horizontal extension 224D. As a result, the third arm end 224E lies in a same plane as the second arm end 224C and in a plane perpendicular to the plane that holds both the first support arm 224B and the horizontal extension 224D. The second and third arm ends 224C. 224E are therefore preferably substantially parallel to each other, as well as substantial similar in length. Finally, the third arm end 224E extends into a second support arm 224F in a substantially similar direction, at a substantially similar angle, and in substantially the same plane as the first support arm 224B. The second support arm 224F preferably terminates with a terminal elbow 224G in the shape of a 180° arc, as depicted in FIG. 2. As discussed in detail below, the horizontal extension/second and third arm end 224D/224C. 224E combination and the first support arm/terminal elbow 224B/224G combination of proximal base end 224, respectively, act as a first fastening mechanism and second fastening mechanism, respectively, when the removable wire hook 220 is engaged with a hanger body.

Figure 3:
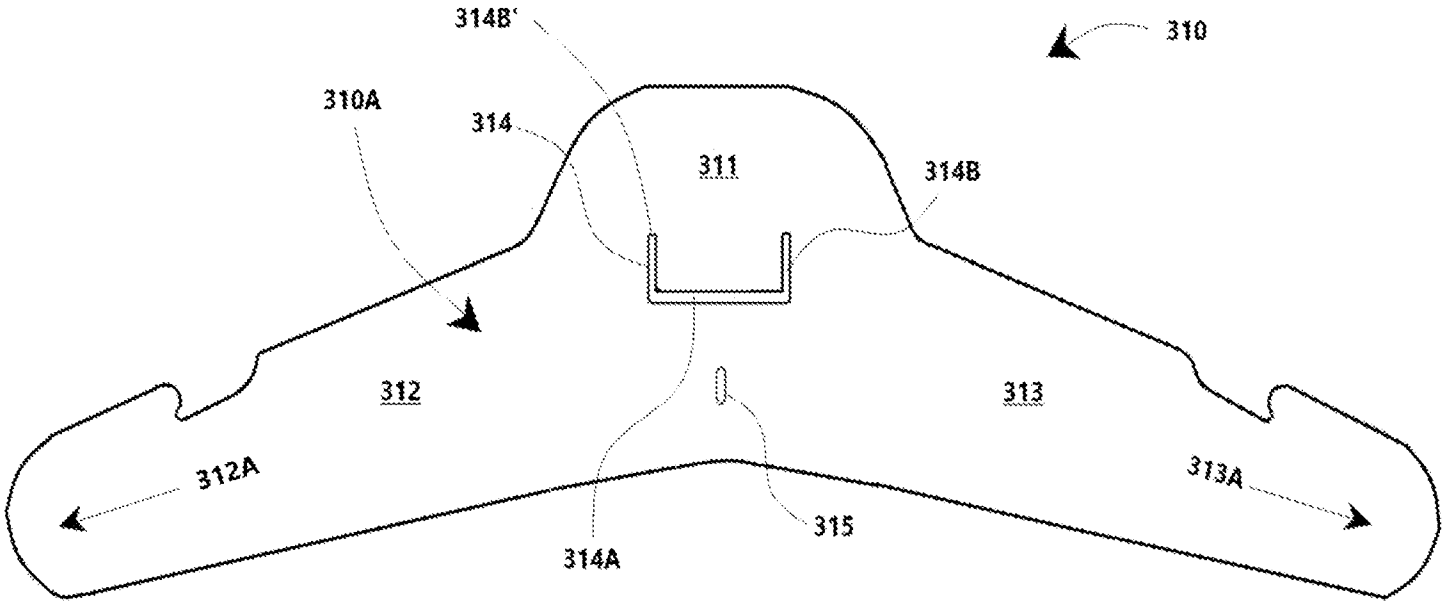
FIG. 3 is a front view of a garment hanger body of the garment hanger assembly of FIG. 1.

FIG. 3 depicts a hanger body 310 that can be used with the removable wire hook 220 of FIGS. 2*a*-2*f* to afford the garment hanger assembly of FIG. 1*a* and FIG. 1*b*. Hanger body 310 is made from multi-layered corrugated paper and has a shape of a garment hanger with a central region 311, a first side region 312 extending from the central region 311 in a first direction 312A, and a second side region 313 extending from the central region 311 in a second direction 313A opposing the first direction 312A. The hanger body 310 includes at least one aperture 314 in the central region 311 for receiving the proximal base end 224, and preferably the horizontal extension 224D of the proximal base end 224, of the removable wire hook 220. The aperture 314 extends through the width of the hanger body 310 and is configured to be a particular shape. For example, as shown in FIG. 3, the at least one aperture 314 in the central region 311 of the hanger body 310 is in the shape of the letter "U" with a horizontal aperture portion 314A and two parallel aperture portions 314B extending perpendicular upwards on either side of the horizontal portion 314*a* to give the "U" preferably squared corners at the bottom. The first aperture 314 and the horizontal extension 224D are both configured such that the horizontal extension 224D friction fits into the first aperture 314 when said horizontal extension 224D is inserted into the horizontal portion 314A of aperture 314 by a user. By "friction fit" as used herein is meant a form of fastening between two tight fitting mating parts that produces a joint which is held together by friction after the parts are pushed or pressed together.

The hanger body 310 can additionally comprise a second aperture 315 in the central region 311 for receiving the proximal base end, and preferably the terminal elbow 224G of the proximal base end 224, of the removable wire hook 220. The second aperture 315 also extends through the width of the hanger body 310 and is configured to be a particular shape. For example, as shown in FIG. 3, the second aperture 315 in the central region 311 of the hanger body 310 is in the shape of a stadium or pill. The second aperture 315 and the terminal elbow 224G are both configured such that terminal elbow 224G friction fits into the second aperture 315 when said arm end 224G is inserted into aperture 315 by a user.

The removable attachment of wire hook 220 to paper hanger body 310 of garment hanger assembly 100 is shown in FIGS. 4*a*-4*c*. In particular, the horizontal extension 224D and the terminal elbow 224G of proximal base end 224 are designed as a first fastening mechanism 224D and second fastening mechanism 224G, respectively, to hold the removable wire hook 220 securely attached to the paper hanger body 310 when horizontal extension 224D is inserted into first aperture 314 and the terminal elbow 224G is inserted into second aperture 315. Initially, and as depicted in FIG.

4*a*, horizontal extension 224D is guided by a user in a direction 224D' towards the horizontal aperture portion 314A of first aperture 314 until it is inserted all the way through said horizontal aperture portion 314A. This allows one of the two parallel aperture portions 314B on either side of the horizontal portion 314A to align with the second arm end 224C and the other one of the two parallel aperture portions 314B on the opposite side of the horizontal portion 314A to align with the third arm end 224E, as seen in FIG. 4*b*. The user then slides the second arm end 224C and the third arm end 224E through the respective parallel aperture portions 314B in a direction 224C' and 224E', respectively, until they each contact a respective aperture portion end 314B' (see FIG. 3 and FIG. 4*b*), thereby allowing the second arm end 224C and the third arm end 224E to become frictionally fit with the first aperture 314 (see FIG. 4*c*). Second arm end 224C and the third arm end 224E can thereby be considered a portion of the first fastening mechanism 224D along with the horizontal extension 224D. In addition, terminal elbow 224G is now aligned with second aperture 315 and is pressed therethrough such that at least a portion of said terminal elbow 224G is friction fit with second aperture 315 (see FIG. 4*c*, a portion of terminal elbow 224G in broken lines as not shown). Horizontal extension 224D (see FIG. 4*c*, broken line portions as not shown) now rests firmly against the surface 310A of hanger body 310 between the second arm end 224C and the third arm end 224E near both aperture portion ends 314B', while at least a portion, and preferably all, of the first support arm 224B and second support arm 224F are resting firmly against the surface 310A of hanger body 310 opposite that of horizontal extension 224D (see FIG. 4*c*). The first support arm 224B and second support arm 224F can thereby provide additional support for when the wire hook 220 is removably attached to the hanger body. Removable wire hook 220 can be easily disassembled from hanger body 310 by first pushing terminal elbow 224G back through second aperture 315, sliding second and third arm ends 224C, 224E through two parallel aperture portions 314B back towards horizontal portion 314A, and pushing horizontal extension 224D back through first aperture 314.

Figure 5:
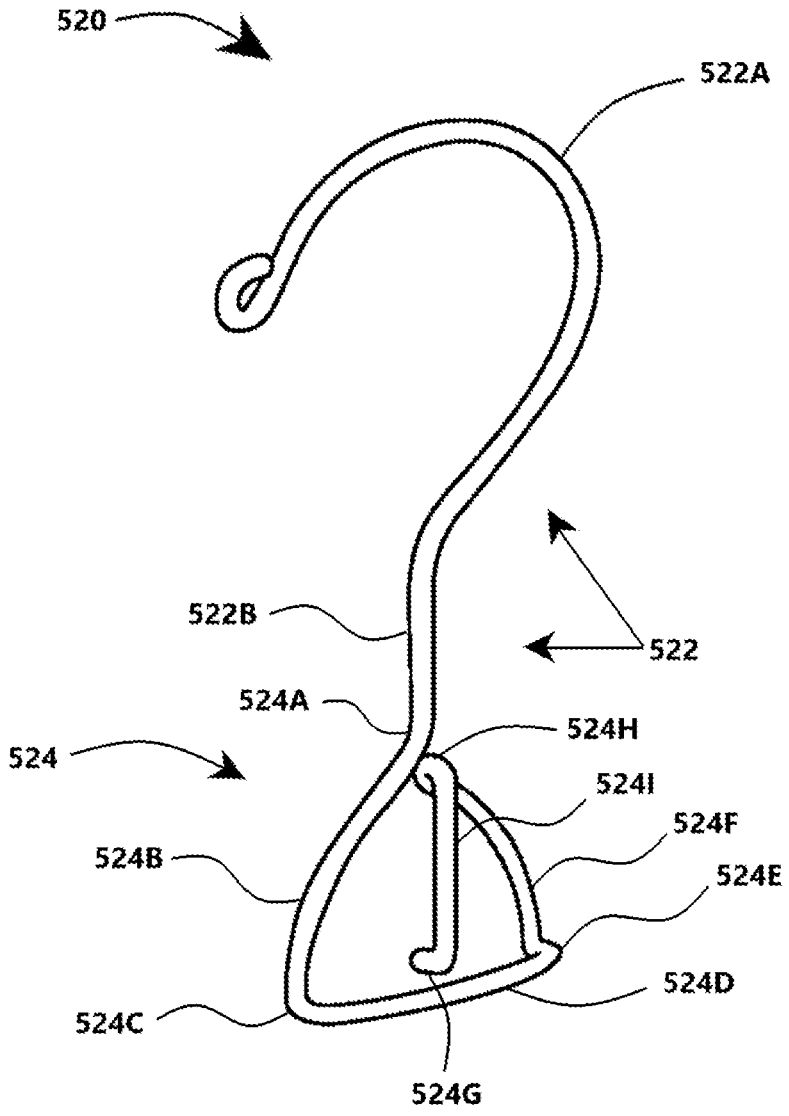
FIG. 5 is a front perspective view of another embodiment for a removable wire hook.

In an alternate, non-limiting embodiment of a removable wire hook, FIG. 5 shows a front perspective view of a removable wire hook 520 that can be used for garment hanger assembly 100 of FIG. 1 according to the present invention. Removable wire hook 520 has similar features as removable wire hook 220 but the proximal base end 524 of wire hook 520 is bent into a shape of a triangle. Accordingly, the distal hook end 522 of wire hook 520 includes an arcuate hook 522A followed by a vertical extension 522B, while the proximal base end 524 similarly comprises a horizontal extension 524D that is substantially perpendicular to the vertical extension 522B of the distal hook end 522. The horizontal extension 524D is configured to engage a portion of the hanger body when the wire hook 520 is removably attached to said hanger body 110. The proximal base end 524 of the removable wire hook 520 can further comprise a first support arm 524B that extends at an angle from a first arm end 524A in a medial direction (i.e. in a direction with the arcuate hook 522A). Alternatively, the first support arm 524B can extend at an angle from the first arm end 524A in a lateral direction (i.e. in a direction against the arcuate hook 522A). Preferably, the first support arm 524B extends medially or laterally from the first arm end 522A in substantially a same plane as the vertical extension 522B of the distal hook end 522. Regardless, the first support arm 524B continues to extend at an angle towards a second arm end 524C, said second arm end 524C further extending into the horizontal extension 524D of the proximal base end 524. The second arm end 524C extends from the first support arm 524B and into the horizontal extension 524D in a direction, preferably 90°, such that said horizontal extension 524D lies in a different plane than said first support arm 524B. Preferably, the horizontal extension 524D therefore also lies in a different plane than the first support arm 524B. The horizontal extension 524D continues to extend horizontally into a third arm end 524E that itself extends back in an opposite and equal direction, preferably 90°, from where the second arm end 524C extends into said horizontal extension 524D. As a result, the third arm end 524E lies in a same plane as the second arm end 524C and in a plane perpendicular to the plane that holds both the first support arm 524B and the horizontal extension 524D. The second and third arm ends 524C, 524E are therefore preferably substantially parallel to each other, as well as substantial similar in length. Finally, the third arm end 524E extends into a second support arm 524F at a substantially similar angle and in substantially the same plane as the first support arm 524B, but in a direction back towards the first arm end 524A, thereby completing the "triangle" shape of the proximal base end 524 of the wire hook 520. The second support arm 524F preferably extends into a fourth arm end 524H that continues at substantially a 90° angle away from, and perpendicular to, the first arm end 524A, as shown in FIG. 5. The fourth arm end 524H then extends into a third support arm 524I, which extends downward at substantially a 90° angle and terminates with a terminal elbow 524G in the shape of a 180° arc.

Referring again to FIG. 1 and FIG. 5, the horizontal extension 524D and terminal elbow 524G act as a first locking mechanism and second mechanism, respectively, when the removable wire hook 520 is engaged with hanger body 110, and specifically when horizontal extension 524D is inserted into first aperture 114 and the terminal elbow 524G is inserted into a second aperture 115 of hanger body 110. It is to be understood that the second aperture 115 can be a notch 115 in first aperture 114, as shown in FIG. 1, or separate and apart from the first aperture 114, either above or below said first aperture 114, depending on the length of third support arm 524I. Initially, horizontal extension 524D is inserted into the first aperture 114 of hanger body 110 resulting in said horizontal extension 524D being friction fit with aperture 114. Proximal base end of 524 of removable wire hook 520 is configured such that the length of fourth arm end 524H extends back over the top of the central region 111 of hanger body 110 for the entire width of said hanger body 110, and the length of third support arm 524I provides for alignment of terminal elbow 524G with the second aperture 115. The terminal elbow 524 can then be pressed into the second aperture 115 resulting in said terminal elbow being friction fit with aperture 115. The resulting garment hanger assembly therefore provides for the horizontal extension 524D being inserted on one side of hanger body 110 while the terminal elbow 524G is inserted on the opposite side of the hanger body 110. Removable wire hook 520 can be easily disassembled from hanger body 310 by pushing terminal elbow 524G back through second aperture 315 and pushing terminal elbow 524G back through first aperture 314.

Although various embodiments of the garment hanger assembly are illustrated and described herein, it is appreciated that other embodiments are contemplated as being within the scope of the present disclosure and that various substitutions may be made by those skilled in the art without departing from the spirit of the same.

What is claimed is:

1. A paper hanger assembly comprising:

a hanger body comprising a central region, a first side region extending from the central region in a first direction, a second side region extending from the central region in a second direction opposing the first direction, a first aperture in the central region of the hanger body, and a second aperture in the central region of the hanger body; and a removable wire hook for a garment hanger, the removable wire hook comprising a distal hook end and a proximal base end, wherein the distal hook end comprises an arcuate hook followed by a vertical extension, and the proximal base end comprises a horizontal extension that is perpendicular to the vertical extension of the distal hook end, the horizontal extension configured to engage a hanger body when the wire hook is removably attached to the hanger body;

wherein the first aperture has a horizontal aperture portion and two parallel aperture portions extending perpendicular on either side of the horizontal portion, and configured to receive the horizontal extension of the removable wire hook when the removable wire hook is removably attached to the paper body, and the second aperture is configured to receive a terminal elbow of the proximal base end of the removable wire hook when the removable wire hook is removably attached to the paper body.

2. A removable wire hook according to claim 1, wherein the proximal base end of the removable wire hook further comprises a first support arm that extends at an angle from a first arm end in a medial direction from said vertical extension, the first support arm in substantially a same plane as the vertical extension.

3. A removable wire hook according to claim 2, wherein the first support arm further extends from the first arm end into a second arm end, the second arm end further extending into the horizontal extension of the proximal base end at substantially a 90° angle such that said horizontal extension lies in a different plane than said first support arm.

4. A removable wire hook according to claim 3, wherein the horizontal extension further extends from the second arm end into a third arm end, the third arm end extending from the horizontal extension in an opposite and equal direction at substantially a 90° angle from where the second arm end extends into the horizontal extension, the third arm end lying in a same plane as the second arm end and in a plane perpendicular to the plane that holds both the first support arm and the horizontal extension, and the second and third arm ends are substantially similar in length and parallel to each other.

5. A removable wire hook according to claim 4, wherein the third arm end further extends from the horizontal extension into a second support arm in a substantially similar direction, at a substantially similar angle, and in substantially a same plane as the first support arm, the second support arm terminating with the terminal elbow in the shape of a 180° arc.

6. The removable wire hook according to claim 5, wherein the horizontal extension of the removable wire hook is inserted through the horizontal aperture portion of the first aperture, thereby aligning the second arm end with one of the two parallel aperture portions of the first aperture, and aligning the third arm end with the other of the two parallel aperture portions of the first aperture, such that the second arm end and the third arm end are pushed through the respective parallel aperture portions until each of the second arm end and the third arm end are in contact with an aperture portion end, the second arm end and the third arm end frictionally fit with the first aperture.

7. The removable wire hook according to claim 6, wherein the terminal elbow is aligned with and pressed through the second aperture such that at least a portion of said terminal elbow is friction fit with the second aperture, the horizontal extension of the removable hook is in contact with a surface of the hanger body, and at least a portion of the first support arm and second support arm are in contact with the surface of the hanger body opposite from horizontal extension.

8. A paper hanger assembly according to claim 1, wherein the horizontal extension of the proximal base end is configured to friction fit into a hanger body surface when the horizontal extension is pressed through the first aperture.

9. A paper hanger assembly according to claim 8, wherein the paper hanger body is made from at least two layers of corrugated paper and having a shape of a garment hanger with a central region, a first side region extending from the central region in a first direction, and a second side region extending from the central region in a second direction opposing the first direction, wherein a first layer of corrugated paper is oriented at substantially a 90° angle corrugation relative to a second layer of corrugated paper.

10. A paper hanger assembly according to claim 9, wherein the first layer of corrugated paper comprises two or more sub-layers of a first corrugated paper and the second layer comprises two or more sub-layers of a second corrugated paper.

11. A paper hanger assembly according to claim 10, wherein the two or more sub-layers of the first corrugated paper is of a different size than the two or more sub-layers of the second corrugated paper.

12. A paper hanger assembly according to claim 11 further comprising a third layer of corrugated paper, wherein the second layer of corrugated paper is oriented in between the first and second layers of corrugated paper at substantially a 90° angle corrugation relative to both the second and third layers of corrugated paper.

13. A paper hanger assembly according to claim 12, wherein the third layer comprises two or more sub-layers of a third corrugated paper.

14. A paper hanger assembly according to claim 13, wherein the two or more sub-layers of the second corrugated paper are of a different size than the two or more sub-layers of the first corrugated paper and the two or more sub-layers of the third corrugated paper.

15. A paper hanger assembly according to claim 14, wherein the first layer comprises two sub-layers of F-flute corrugated paper in a horizontal flute orientation, the second layer comprises three sub-layers of E-flute corrugated paper in a vertical flute orientation, and the third layer comprises two sub-layers of F-flute corrugated paper in a horizontal flute orientation.

16. A paper hanger assembly according to claim 15, wherein the first layer is laminated to the second layer and the second layer is laminated to the third layer.

17. A paper hanger assembly according to claim 12, wherein the first layer of corrugated paper comprises two sub-layers of E-flute sized corrugated paper oriented in the same direction;

the second layer of corrugated paper comprises three sub-layers of F-flute sized corrugated paper oriented in the same direction of corrugation and in substantially a 90° angle corrugation relative to the first layer of corrugated paper; and the third layer of corrugated paper comprises two sub-layers of E-flute sized corrugated paper oriented in the same direction and in substantially a 90° angle corrugation relative to the second layer.

* * * * *